US006125732A

United States Patent [19]

Haug

[11] Patent Number: 6,125,732

[45] Date of Patent: Oct. 3, 2000

[54] LETTER OPENER

[76] Inventor: Werner Haug, Oberstrasse 12, CH-3550 Langnau im Emmental, Switzerland

[21] Appl. No.: 09/180,644

[22] PCT Filed: Feb. 24, 1998

[86] PCT No.: PCT/CH98/00072

§ 371 Date: Dec. 28, 1998

§ 102(e) Date: Dec. 28, 1998

[87] PCT Pub. No.: WO98/40227

PCT Pub. Date: Sep. 17, 1998

[30] Foreign Application Priority Data

Mar. 11, 1997 [CH] Switzerland ..... 568/97

[51] Int. Cl.[7] ..... B26D 1/18

[52] U.S. Cl. ..... 83/485; 83/582; 83/614; 83/912

[58] Field of Search ..... 83/614, 508, 582, 83/912, 455, 485, 583, 489

[56] References Cited

U.S. PATENT DOCUMENTS

| | | | |
|---|---|---|---|
| 2,672,933 | 3/1954 | Bridy | 164/73 |
| 3,301,117 | 1/1967 | Spaulding | 83/614 X |
| 3,821,915 | 7/1974 | Larrable . | |
| 4,046,044 | 9/1977 | Paterson et al. | 83/508 X |
| 4,257,294 | 3/1981 | Stoveken | 83/582 X |
| 4,419,915 | 12/1983 | Oussani | 83/912 X |
| 4,448,101 | 5/1984 | Templeton | 83/508 X |
| 4,686,876 | 8/1987 | Hume et al. | 83/508 X |
| 4,941,380 | 7/1990 | Lockwood | 83/614 X |
| 4,960,022 | 10/1990 | Chuang | 83/614 X |
| 5,307,716 | 5/1994 | Onishi et al. . | |
| 5,322,001 | 6/1994 | Boda . | |
| 5,440,961 | 8/1995 | Lucas, Jr. et al. | 83/614 X |
| 5,524,515 | 6/1996 | Boda | 83/614 X |
| 5,819,618 | 10/1998 | Rodriguez | 83/485 X |
| 5,904,085 | 5/1999 | Onishi et al. . | |
| 5,996,459 | 12/1999 | Cornell et al. . | |

FOREIGN PATENT DOCUMENTS

| | | |
|---|---|---|
| 0703097 | 3/1996 | European Pat. Off. . |
| 660571 | 5/1987 | Switzerland . |
| 500633 | 2/1939 | United Kingdom . |

*Primary Examiner*—Kenneth E. Peterson
*Attorney, Agent, or Firm*—Friedrich Kueffner

[57] ABSTRACT

A letter opener, especially intended for manual operation, is proposed, which can open a conventional envelope without producing any waste. For this purpose, it has a round knife (3), mounted by way of spring-generated pretension (7) between two rails (4, 40), the diameter of the knife being slightly smaller than twice the smallest possible distance between the axis of the knife and the letter support surface (1).

9 Claims, 2 Drawing Sheets

LETTER OPENER

BACKGROUND OF THE INVENTION

1. Field of the Invention

The present invention pertains to a letter opener with a round knife.

2. Description of the Related Art

An extremely wide variety of letter openers which produce a waste strip while opening an envelope are known from the literature. In this regard, reference can be made merely by way of example to the device for opening envelopes described in CH-A-660,571. In openers of this type, waste is produced, which must be disposed of. In addition, the content of the envelope can also be cut when the envelope is slit open.

Devices are also known which open an envelope without producing any waste. In the machines described in U.S. Pat. No. 4,419,915 and in EP-A-703,097, the envelope is carried by transport devices (belts and similar means of conveyance) past a knife mounted permanently in a housing. Machine designs of this type are complicated and expensive. In addition, there is often the danger that, because of the cutting moment and the transport or braking forces acting at a different point on the letter, the letter can be rotated or upended during the cutting process.

SUMMARY OF THE INVENTION

It is therefore the task of the invention to propose a letter opener of simple design which can be produced at favorable cost and which causes no problems with respect to the relative motion between the letter and the knife. It is also to be possible to start the opening process without the usually tedious task of aligning the letter with the blade as known from many letter openers and without the delicate job of inserting the edge of the letter into a feed slot. In addition, with a properly designed knife, it is to be possible to open the letter without the production of waste. "Waste" is understood here to mean parts of the envelope material, e.g., long strips, which are larger than the dust particles which are inevitably formed by cutting. A goal of the invention is also to provide a letter opener which can be operated by hand.

This task is accomplished by the knife being mounted in a knife housing, which can be moved by hand or driven by a motor along a rail, where a pretensioning (biasing) force acts between the knife and the rail or where means are provided to produce this pretensioning (biasing) force.

Thanks to the pretension between the knife and the rail, production tolerances involving the knife and the knife housing as well as the guide rails and the pressure roll are compensated. The knife always acts with essentially the same force on the letter. As shown in the dependent claims, this pretensioning force can be easily realized in a manner which is very simple in terms of design and which nevertheless operates reliably, e.g., by means of spring-loaded pressure rolls, which act on a shoulder of the round knife. The knife housing, which is provided with a grip, for example, can be slid down the rails without the need to exert very much force, and the letter to be opened can simply be laid freely from above against the lower rail, which simultaneously serves as a stop.

Of course, the knife slide can also be driven by a motor, acting by way of, for example, an additional toothed rack or a toothed transport belt; the motor itself can either travel along with the slide or be mounted in a stationary position (no detailed description of these variants is provided, because in our opinion solutions of this type are familiar to any expert in the field). In summary, a letter opener designed in accordance with the invention is characterized by few parts; a low-cost, compact design; and, thanks to the frictionless rolling motion, by small drive or feed forces. This design also allows an attractive, functional appearance, so that the letter opener also becomes highly suitable as a gift or promotional item.

BRIEF DESCRIPTION OF THE DRAWING

In the following, an embodiment of the letter opener according to the invention is described in greater detail on the basis of the attached figures.

DESCRIPTION OF THE PREFERRED EMBODIMENTS

Figure 1B:
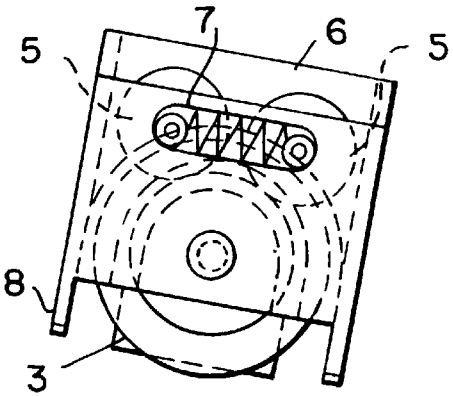
FIG. 1*a* shows a cross section through the knife housing and the letter support surface (with a detailed view of the pressure rolls pretensioned by the springs shown in FIG. 1*b*)
Figure 1A:
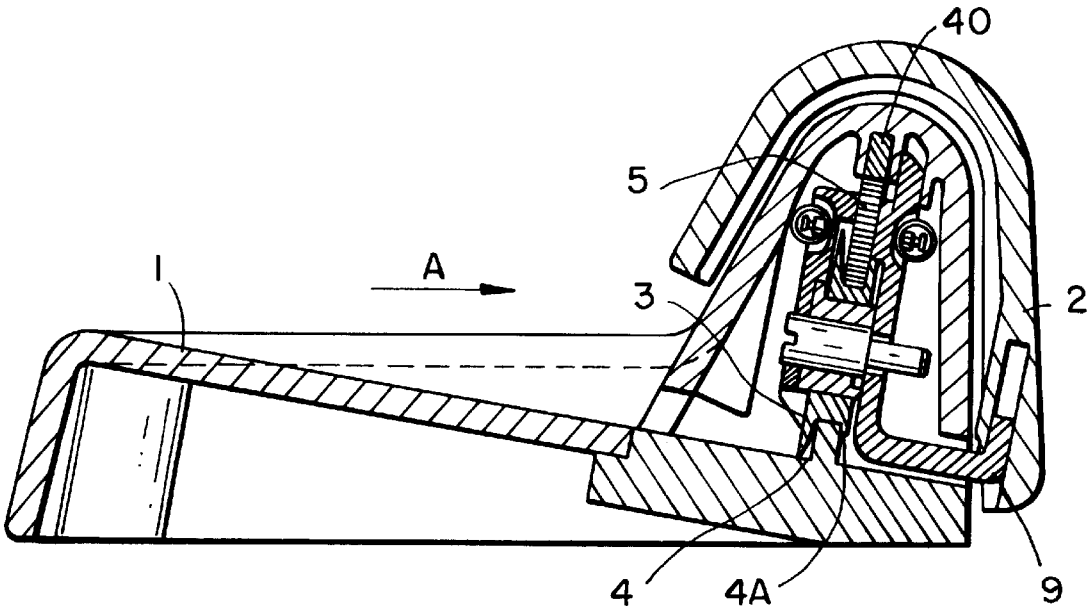

The letter opener consists essentially of a stationary part with a letter support surface 1 and a movable knife housing essentially in the form of a grip 2.

A slanted surface 1 of the opener serves to support the letter. The letter is laid in the simplest way by hand on surface 1 and pressed slightly downward in the direction of arrow A until its longitudinal edge rests against stop 4.

This stop 4 simultaneously forms one of the guide rails, on which an integral shoulder 4A of a round knife 3 can roll alongside the letter. Guide rail 4 projects into a groove formed in the area of the shoulder of the knife and thus guarantees the lateral guidance of the knife.

A second guide rail 40, also connected to the stationary part, is located in the elevated area opposite surface 1. The two pressure rolls 5 roll along this second rail 40. These two rolls 5 are connected by their extended rotational axes to springs 7, which exert tension on them. The axles of rolls 5 are also guided in slots of a component 8, which holds the axle of the knife. In the mounted state, rolls 5 are pressed apart on the periphery of shoulder 4A by upper guide rail 40 against the action of the spring; that is, spring 7 exerts pretension on the two rolls. In this way, production tolerances, especially with respect to the distance between the two rails 4 and 40, are compensated. Simultaneously, the lower rail is pressed securely into the groove in the shoulder of the knife. Because the blade of the knife is set back by 1–10 hundredths of a millimeter from support surface 1, knife 3 cuts only the top layer of paper as it is pulled across the envelope. Because rail 4 rests on the base of the groove, the knife can never touch the letter support surface. To protect the knife blade from any hard objects in the envelope, a second shoulder with a slightly smaller diameter than the blade can be formed on the side of the knife facing the envelope. Items projecting from the envelope (e.g., paper clips) will thus lift the additional shoulder and with it the knife blade. Because the knife, with its pretensioned guidance, can be pressed elastically back to the upper rail, the blade is thus protected to a not inconsiderable degree.

During the actual cutting process, the knife housing, i.e., the grip 2, is moved along the rails. Grip 2 is connected by a hook-shaped strap 9 to component 8.

Figure 2C:
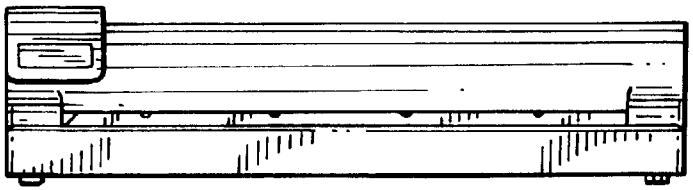
FIGS. 2*a*, 2*b*, 2*c*, and 2*d* show sketches of the letter opener from various angles.
Figure 2D:
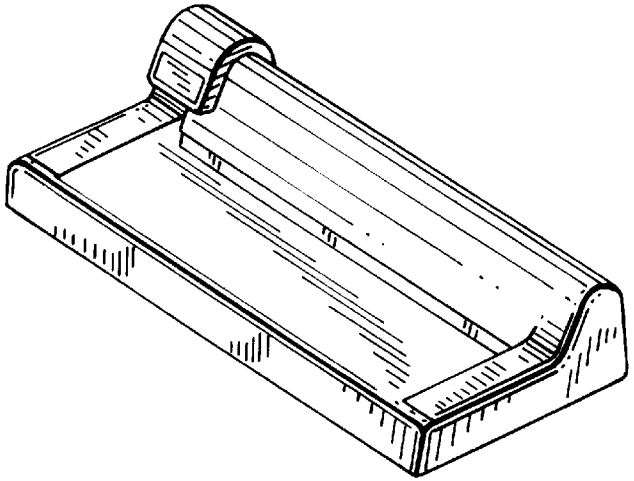
Figure 2A:
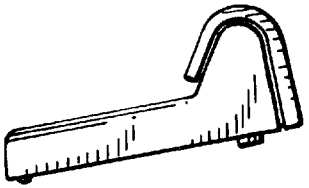
Figure 2B:
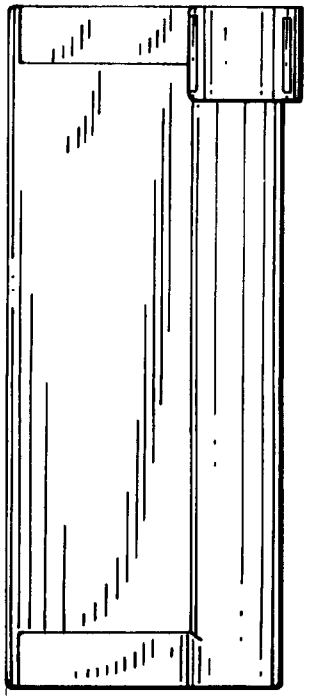

As the housing views in FIG. 2 show, there are only two elements which are visible externally: the letter support surface and the movable knife housing.

The invention is not limited to the design described here and illustrated in the figures. On the contrary, it comprises any letter opener in which the principle of the claims is realized. Of course, the required pretension between the knife and the rails can also be produced by other tensioning elements. Flat spiral springs or pretensioned rubber elements which perform the same function as tension springs 7 are also conceivable. It is also possible to produce the pretension by means of a special design of knife support component 8 itself, that is, by using the elasticity of support 8, which is available either because of the nature of the material or its shape. Reference should be made at this point to the wide variety of fastening elements (clamps, etc.) which usually perform an elastic function. Of course, supports 8 designed in this way can also have rolls attached to them, by which the supports rest on the rails; this reduces the resistance of the knife support to its back-and-forth motion. Low-friction, rigid sliding elements made of plastic, for example, can also be provided in place of rolls.

The option is reserved to supplement the claims with parts of the specification/drawing. It is conceivable in particular that, instead of operation by hand described here, a motor can be provided to advance the knife housing. Any device which opens envelope-like bags or containers in the manner described also falls within the scope of protection.

What is claimed is:

1. A letter opener comprising:

a stationary part having a letter support surface;

a guide assembly comprising a first guide rail connected to the stationary part at one end of the letter support surface;

a knife assembly moveably mounted on the guide assembly;

the knife assembly comprising a knife housing and a round knife rotatably mounted inside the knife housing;

the guide assembly comprising a second guide rail extending parallel to the first guide rail and positioned inside the knife housing;

the round knife positioned between the first and second guide rails and having a radially recessed circumferential shoulder engaging the first guide rail;

the knife assembly having means for biasing the round knife against the first guide rail to establish a drive connection so that the knife assembly is moveable on the first guide rail, the means for biasing positioned between the second guide rail and the round knife and resting against the second guide rail and the round knife.

2. A letter opener according to claim 1, wherein the means for biasing comprise two rolls extending in a common rotational plane and tension springs connecting the two rolls to one another such that an axial spacing between the two rolls is adjustable, wherein the two rolls rest against the second guide rail and against the round knife.

3. A letter opener according to claim 2, wherein the round knife has a circumferential guide groove radially recessed relative to the shoulder and wherein the two rolls engage the circumferential guide groove.

4. A letter opener according to claim 1, wherein the guide assembly comprises a protective cover configured to protect the knife assembly and projecting upwardly from the letter support surface.

5. A letter opener according to claim 4, wherein the knife assembly has a strap connected to the knife housing at a side of the round knife facing away from the letter support surface, wherein the knife housing is a grip connected to the strap.

6. A letter opener according to claim 5, wherein the grip is configured to surround the protective cover at least in an upper area thereof.

7. A letter opener according to claim 1, wherein the first guide rail has a height, measured from the letter support surface upwardly in a plane parallel to the plane of the round knife, that is 1/100 mm to 10/100 mm greater than one half of a diameter difference between the round knife diameter and the diameter of the guide groove.

8. A letter opener according to claim 1, wherein the height of the first guide rail is 1/100 mm to 4/100 mm greater than one half of a diameter difference between the round knife diameter and the diameter of the guide groove.

9. A letter opener according to claim 1, wherein the letter support surface is slanted relative to the horizontal and wherein the plane of the round knife is approximately positioned at a right angle to the letter support surface.

* * * * *